US009335086B2

(12) United States Patent
Koo et al.

(10) Patent No.: US 9,335,086 B2
(45) Date of Patent: May 10, 2016

(54) REFRIGERATOR

(71) Applicant: LG ELECTRONICS INC., Seoul (KR)

(72) Inventors: Min Bon Koo, Gyeongsangnam-do (KR); Jong Wook An, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/848,512

(22) Filed: Sep. 9, 2015

(65) Prior Publication Data

US 2016/0047590 A1 Feb. 18, 2016

Related U.S. Application Data

(63) Continuation of application No. 12/756,219, filed on Apr. 8, 2010, now Pat. No. 9,217,601.

(30) Foreign Application Priority Data

Dec. 22, 2009 (KR) ..... 10-2009-0129260
Dec. 22, 2009 (KR) ..... 10-2009-0129261

(51) Int. Cl.

| | |
|---|---|
| ***F25D 23/00*** | (2006.01) |
| ***F25D 23/02*** | (2006.01) |
| ***F25D 25/02*** | (2006.01) |
| ***F25D 23/04*** | (2006.01) |
| ***F25D 31/00*** | (2006.01) |

(52) U.S. Cl.

CPC ..... *F25D 23/021* (2013.01); *F25D 23/028* (2013.01); *F25D 23/04* (2013.01); *F25D 25/025* (2013.01); *F25D 31/005* (2013.01); *F25D 2400/02* (2013.01); *F25D 2400/16* (2013.01)

(58) Field of Classification Search

CPC ..... F25D 25/025; A47B 51/00
See application file for complete search history.

(56) References Cited

U.S. PATENT DOCUMENTS

| | | | |
|---|---|---|---|
| 4,765,696 | A | 8/1988 | Cordill |
| 5,388,427 | A | 2/1995 | Lee |
| 5,638,689 | A | 6/1997 | Scaringe |
| 6,343,454 | B1 | 2/2002 | Fisher |
| 6,779,855 | B2 | 8/2004 | Hoffman |
| 7,183,502 | B1 | 2/2007 | Johnston |
| 7,407,240 | B2 | 8/2008 | Collins |
| 2002/0117949 | A1 | 8/2002 | Banicevic |
| 2004/0035129 | A1 | 2/2004 | Kaiser |
| 2004/0100169 | A1 | 5/2004 | Huber |
| 2005/0236947 | A1 | 10/2005 | LeClear |
| 2005/0258725 | A1 | 11/2005 | Jang |
| 2006/0086126 | A1 | 4/2006 | Montuoro |
| 2006/0087207 | A1 | 4/2006 | Oh |
| 2006/0097611 | A1 | 5/2006 | Kim |
| 2006/0250059 | A1 | 11/2006 | Lemm |
| 2007/0144408 | A1 | 6/2007 | Rotter |
| 2008/0066821 | A1 | 3/2008 | Komiya |
| 2008/0302125 | A1 | 12/2008 | Cushman et al. |
| 2008/0303401 | A1 | 12/2008 | Ji |
| 2009/0140622 | A1 | 6/2009 | Suetsugu |
| 2009/0160297 | A1 | 6/2009 | Anikhindi et al. |
| 2010/0162747 | A1 | 7/2010 | Hamel et al. |
| 2011/0162402 | A1 | 7/2011 | Park |

FOREIGN PATENT DOCUMENTS

| | | |
|---|---|---|
| KR | 10-2006-0025806 | 3/2006 |
| WO | WO 2007/147180 A2 | 12/2007 |

*Primary Examiner* — Cassey D Bauer
(74) *Attorney, Agent, or Firm* — Fish & Richardson P.C.

(57) ABSTRACT

The embodiment relates to a refrigerator. In the refrigerator, a freezing compartment is selectively partitioned into a plurality of spaces and some of the plurality of spaces can be used as a convertible compartment that can be converted into the refrigerating compartment and the freezing compartment. In addition, the refrigerator has a structure that an operation unit is provided at a door that opens and closes the convertible compartment and a cable that extends from a main body to the operation unit is clearly processed.

6 Claims, 6 Drawing Sheets

REFRIGERATOR

CROSS-REFERENCE TO RELATED APPLICATIONS

The present application is a continuation of U.S. application Ser. No. 12/756,219, filed Apr. 8, 2010, now allowed, which claims priority under 35 U.S.C. 119 and 35 U.S.C. 365 to Korean Patent Application Nos. 10-2009-0129260 and 10-2009-0129261 both of which were filed on Dec. 22, 2009, and are hereby incorporated by reference in their entirety.

BACKGROUND OF THE INVENTION

The embodiment relates to a refrigerator.

Generally, a refrigerator is home appliances that stores food in a low temperature state by a low-temperature air.

Currently, there has been increasing a demand for a bottom freezer type refrigerator whose refrigerating compartment is provided at an upper side and freezing compartment is provided at a lower side. In the case of the bottom freezer type refrigerator, an ice making device that makes ice and a water dispenser that can take out drinking water may be provided at a door.

In the bottom freezer type refrigerator, a pair of refrigerating compartment doors that are rotatably provided at the front surface of the main body opens and closes the refrigerating compartment and a freezing compartment door is opened and closed by a door that is provided at a drawer that move forward and backward. That is, the door that opens and closes the freezing door moves forward and backward in a vertical state to open and close the freezing compartment.

Currently, the refrigerator that includes a plurality of freezing compartments partitioned up and down has been released. However, the bottom freezer type refrigerator including the plurality of freezing compartments has a structure that cold air that is introduced into any one of the freezing compartment is not transferred to another freezing compartment. In addition, since two freezing compartment spaces cannot be combined into one space, it is difficult to receive freezing food having a large volume.

In recent, there has been increasing a demand for a convertible compartment function that can use some of the freezing compartments partitioned in plural as the freezing compartment or the refrigerating compartment. In this case, an operation unit that can select and control the convertible compartment function needs to be installed at the door. To this end, a power line cable and a signal line cable need to be installed at the door that is movably provided forward and backward. In addition, these cables should be installed not to hinder the movement of the door.

SUMMARY OF THE INVENTION

The present invention has been made in an effort to input a front and rear drawing in and out commands of a convertible compartment door or a freezing compartment door through an operation unit provided at a convertible compartment compartment or a freezing compartment door and thus, perform a safe process of a cable.

In addition, The present invention has been made in an effort to provide a refrigerator that can separate a space at a lower side of a refrigerating compartment into one or more space and can use any one of a plurality of spaces as a convertible compartment compartment.

In order to achieve the above objects, there is provided a refrigerator according to an embodiment of the present invention, comprising:

There is provided a refrigerator according to another embodiment of the present invention, comprising:

There is provided a refrigerator according to another embodiment of the present invention, including: a main body in which a storage space having a first outlet and a second outlet are provided; a compressor that compresses a refrigerant; a condenser into which the refrigerant discharged from the compressor flows; a separation member that is removably coupled to the inside of the storage space and is transversely disposed between the first outlet and the second outlet to selectively separate the storage space; and a damper that is provided in at least any one of the outlets and is selectively operated to control an amount of supplied cold air to control the temperature in the refrigerator, wherein any one of the separated storage spaces by the separation member functions as a convertible compartment by the selective operation of the damper.

The refrigerator according to the embodiment of the present invention that has the above-mentioned configuration has the following advantages.

First, the lower side of the freezing compartment can be used as the single freezing compartment space or used as the freezing compartment and the convertible compartment, by the separation member that is removably mounted in the storage space of the lower side of the refrigerating compartment. Therefore, the user can use any one of the separated freezing compartment spaces as the refrigerating compartment when the refrigerating compartment space is lack. To the contrary, if the user has a lot of things to be stored in the freezing compartment, the entire storage space of the lower side of the refrigerating compartment can be used as the single freezing compartment space.

Second, since the separation member is removably mounted in the storage space of the lower side of the refrigerating compartment, the user can easily separate the freezing compartment space without calling the serviceman.

Third, the operation unit is provided at the front surface of the convertible compartment or the freezing compartment door that moves forward or backward, such that the user can conveniently input the operation command.

Fourth, the signal line cable and the power line cable that extend from the main controller of the refrigerator main body is clearly processed, thereby making it possible to prevent the electrical risk due to the interference with the received food or the cable damage during the drawing in and out of the convertible compartment or the freezing compartment door.

DETAILED DESCRIPTION OF THE PREFERRED EMBODIMENTS

Hereinafter, exemplary embodiments of the present invention will be described in detail with reference to the accompanying drawings.

Further, in order to describe the exemplary embodiments of the present invention, a bottom freezer type refrigerator, in particular, a drawer type refrigerator where freezing compartment space is partitioned into a convertible compartment and a freezing compartment and the receiving member of the convertible compartment and the freezing compartment is drawn out forward or backward will be described.

Figure 1:
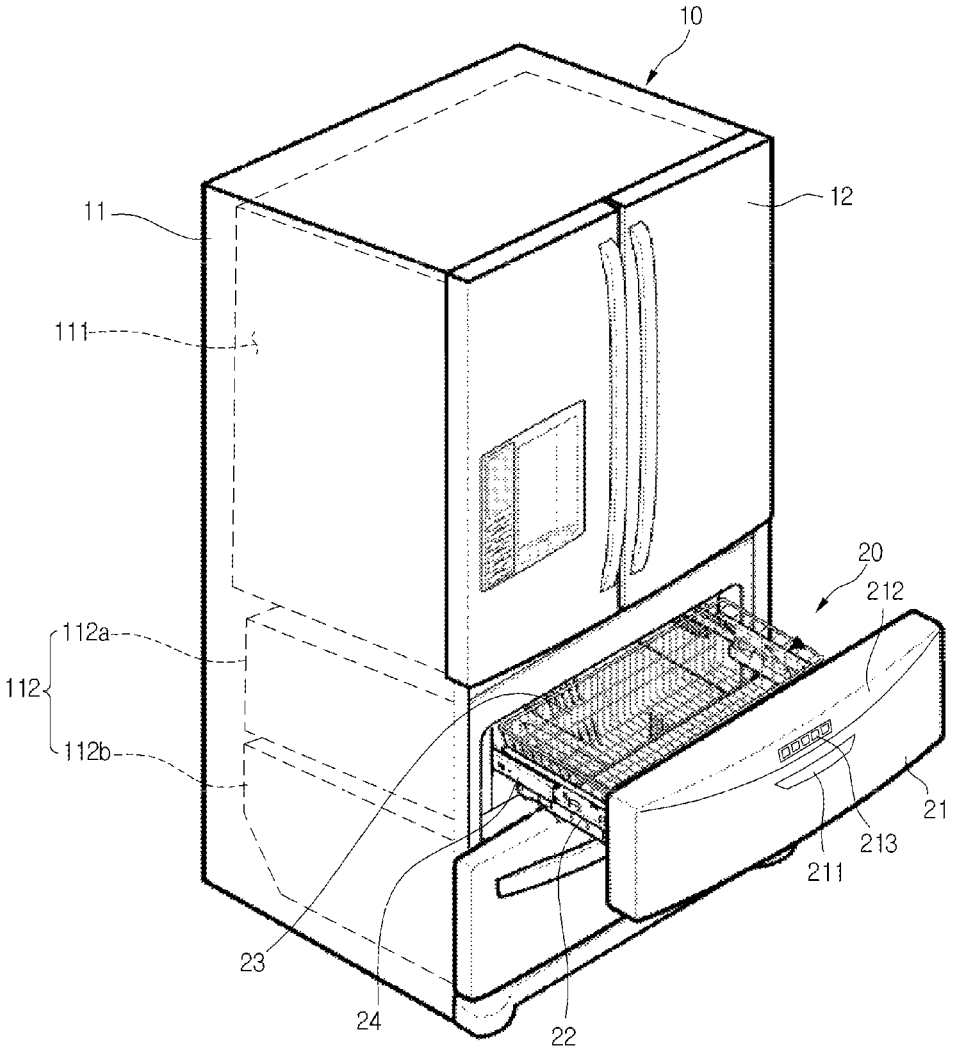
FIG. 1 is an exterior perspective view of a refrigerator according to an embodiment of the present invention.

FIG. 1 is an exterior perspective view of a refrigerator according to an embodiment of the present invention.

Referring to FIG. 1, a refrigerator 10 according to the embodiment of the present invention includes a main body 11 that includes a refrigerating compartment 111 and a freezing compartment 112 therein and a door that opens and closes the refrigerating compartment 111 and the freezing compartment 112 provided at the front surface o the main body 11.

In detail, the refrigerating compartment 111 is formed at the upper side of the main body 11 and the freezing compartment 112 is formed at the lower side of the refrigerating compartment 111. The refrigerating compartment 111 is selectively opened and closed by a pair of refrigerating compartment doors 12 that is rotatably coupled to the front surface of the main body 11. The inner space of the freezing compartment 112 is partitioned. One of the inner space may be used as a convertible compartment 112*a* and the other may be used as a freezing compartment 112*b*. When the convertible compartment 112*a* is used as the freezing compartment, the entire lower storage space 112 of the refrigerating compartment serves as the freezing compartment and when the convertible compartment 112*a* is used as the refrigerating compartment, the lower storage space 112 of the refrigerating compartment will be used as the refrigerating compartment and the freezing compartment.

In addition, each of the convertible compartment 112*a* and the freezing compartment 112*b* is opened and closed by the drawer that is sled forward and backward. Hereinafter, the drawer 20 used in the convertible compartment 112 will be representatively described by way of example.

Figure 2:
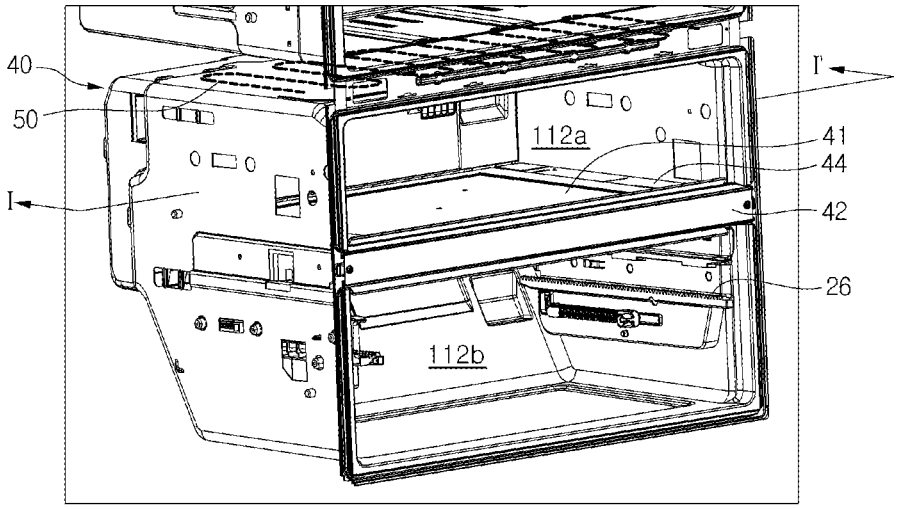
FIG. 2 is a perspective view showing a storage compartment housing that is provided in the refrigerator according to the present invention.

In detail, the drawer 20 that opens and closes the convertible compartment 112*a* and receives food to be stored in the convertible compartment includes a door frame 22 that extends backward from the rear surface of the door 21 and a moving rail 24 whose one end is coupled to the door frame 22. An inner side wall of the convertible compartment 112*a* is formed with a rail guide 26 (see FIG. 2) that supports the moving rail 24 and the rail guide 26 is coupled with a fixing rail 25 (see FIG. 8). Although it is shown in FIG. 2 that the rail guide 26 is provided at the side wall of the freezing compartment, it is noted that the rail guide 26 is also installed in the convertible compartment 112*a*. The other end portion of the moving rail 24 is coupled with the fixing rail 25. Therefore, the moving rail 24 moves forward and backward along the rail guide and the fixing rail. One or more intermediate rail may be further coupled between the fixing rail and the moving rail 24 according to the size of the product. In other words, the intermediate rail and the moving rail 24 are drawn out in multi-stage from the fixing rail, such that a telescopic movement can be made.

Meanwhile, the upper side of the door frame 22 can be removably seated with a receiving box 23. The door 21 that configures the front surface of the drawer 20 moves forward and backward while maintaining the vertical state to selectively shield the convertible compartment 112*a*.

In addition a handle portion 211 is provided at the front surface of the door 21, such that a user can manually draw out the drawer 20. An operation unit 213 is formed between the upper edge portion of the door 21 and the handle portion 211. In detail, an inclined surface 212 is formed at a place where the operation unit 213 is formed. The inclined surface 212 is formed downward at a predetermined angle from the upper edge portion of the door 21. As shown, the front portion of the door 21 is formed to be convexly rounded as going to the central portion from the edge. Therefore, the inclined surface 212 is also formed in the shape that the central portion is widest. The inclined surface 212 is formed at the upper portion of the door 21, thereby removing a phenomenon that the operation unit 213 is covered by the lower end portion of the refrigerating compartment door 12. In other words, the user can view the entire screen of the operation unit 213 without bending his/her waist.

Further, various buttons may be formed in the operation unit 213. Each button may have a form that it is pressed and returns to an original position by the pressing operation of the user and may be a touch sensitive button that is sensed according to the change in capacitance. The buttons may include an command input button that instructs the drawing in and out of the door 21 and a function selection button that can select the convertible compartment and the freezing compartment. Therefore, the buttons formed in the operation unit 213 are operated, thereby making it possible to select the drawing in and out of the door 211 and the inner state of the storage compartment. As described above, since the operation unit is installed at the front surface of the door 21, a signal line cable for transmitting and receiving commands to and from a main controller of the main body 11 and a power line cable for supplying current extend from the main body 11 to the door 21. The connection and processing structure of the cables will be described below with reference to the accompanying drawings.

Figure 3:
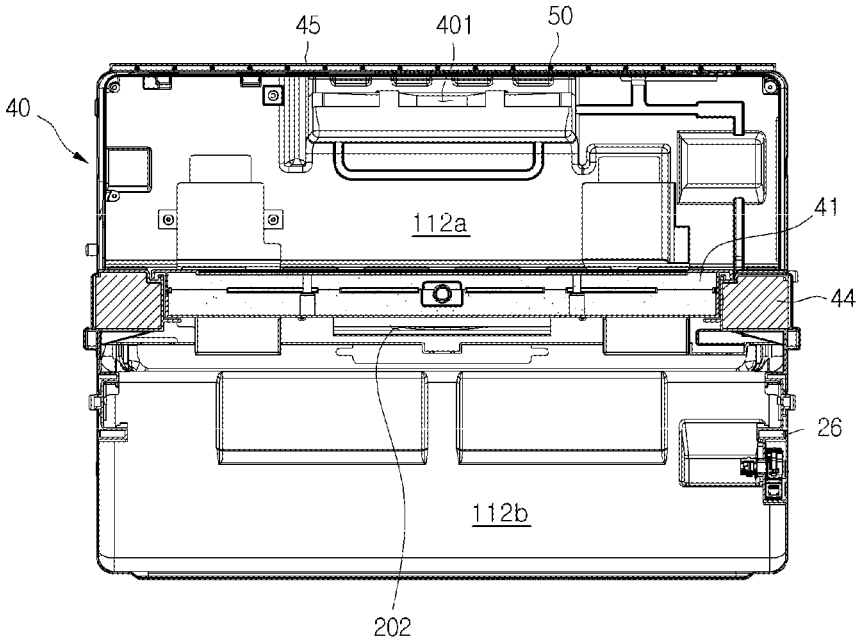
FIG. 3 is a longitudinal cross-sectional view taken along line I-I' of FIG. 2.

FIG. 2 is a perspective view showing a storage compartment housing that is provided in the refrigerator according to the embodiment of the present invention and FIG. 3 is a longitudinal cross-sectional view taken along line I-I of FIG. 2.

Referring to FIGS. 2 and 3, a storage compartment housing 40 according to the embodiment of the present invention is a housing that defines the freezing compartment 112.

In detail, the storage compartment housing 40 can separate the storage space up and down by a separation member 41 that is mounted horizontally. The separation member 41 is removably provided inside the housing 40. A horizontal bar 42 is mounted at the front surface of the separation member 41 and the horizontal bar 42 is fixedly mounted at both side walls of the housing 40. Both side walls of the housing 40 are installed with the rail guide 26, such that the drawer type receiving member slidably moves. As described above, the rail guide 26 is provided at the upper and lower sides of the separation member 41, respectively and the receiving member is received in the upper space 112*a* and the lower space 112*b*, respectively. Any one of the upper space 112*a* and the lower space 112*b* may be used as only the freezing compartment and the other may be used as the convertible compartment. In the present embodiment, the case where the upper space 112*a* is used as the convertible compartment will be described. Therefore, the upper space 112*a* is defined as the convertible compartment and the lower space 112*b* is defined as the freezing compartment in the following description. The user can select whether the upper space 112 is used as the convertible compartment or as the freezing compartment through the operation unit.

Meanwhile, the separation member 41 is configured to include an upper plate 411 (see FIG. 5) and a lower plate 412 (see FIG. 5) and a heat insulating material is interposed between the upper plate 411 and the lower plate 412. The heat insulating material may be a polyurethane foaming insulation material or a separate heat insulating panel such as a vacuum insulation panel (VIP).

Further, both sides of the separation member 41 are each mounted with a supporter 44 that supports the separation member 41. The supporter 44 may be mounted at the side wall of the housing 40 in an integrated state with the rail guide 26.

Moreover, the rear wall of the housing 40 may be formed with a cold air outlet and a cold air inlet. In detail, the rear walls of the convertible compartment 112*a* and the freezing compartment 112*a* are each formed with the cold air outlets 401 and 402. Any one or both of the cold air outlets 401 and 402 may be mounted with a damper. Therefore, the cold air supply amount through the cold air outlet is controlled by the selective operation of the damper, thereby making it possible to control the temperature of the convertible compartment 112*a* and the freezing damper 112*b*.

Moreover, a heater 50 is seated on the upper surface of the housing 40, that is, the upper surface of the convertible compartment 112*a* and the heater 50 is covered by a heater cover 45. Herein, the heater cover 45 prevents heat generated from the heater 50 from being transferred to a space other than the convertible compartment 112*a*. Since the upper side of the convertible compartment 112*a* is formed with the refrigerating compartment 111, heat generated from the heater 50 is transferred to the refrigerating compartment 111, thereby increasing the load of the refrigerating compartment 111. Therefore, the heat generated from the heater 50 should not be transferred to other places by the heater cover 45 itself or a separate unit other than the heater cover 45.

Further, as a unit that increases the temperature of the convertible compartment 112*a*, in addition to the heater 50, a portion of the refrigerant pipe that is provided in the refrigerator can be used.

In other words, a portion of the refrigerant pipe that is connected to the outlet side of the compressor and moves the high-temperature high-pressure gas refrigerant therein is branched and can be arranged on the upper surface of the housing 40 in a meandering S-letter form (meaner line). That is, the branched refrigerant pipe and the compressor may be connected in parallel with each other and may be integrally combined at the inlet side of an expansion member. A valve is installed at the inlet side of the refrigerant pipe, thereby making it possible to selectively move the refrigerant.

Meanwhile, each of the operation units 213 that are formed at the front surface of the door 21 may be provided with buttons that can select the convertible compartment and the freezing compartment. For example, when the user presses the convertible compartment button, the convertible compartment 112*a* may be maintained at a setting temperature higher than that of the freezing compartment 112*b* and when the freezing compartment is pressed, the convertible compartment 112*a* may be maintained at the temperature of the freezing compartment. As another method, the buttons for selecting the temperature of the convertible compartment 112*a* are provided and the user can operate the buttons to set the temperature of the convertible compartment 112*a*. In more detail, when the user inputs the commands for using the upper space 112*a* as the convertible compartment through the operation unit, the controller of the refrigerator can sense them to operate the heater 60. When the temperature of the refrigerator that is sensed by a temperature sensor (not shown) mounted in the convertible compartment 112*a* reaches the set temperature of the convertible compartment, the driving of the heater 50 can stop. In order to maintain the temperature of the refrigerator at the setting temperature, the above-mentioned dampers can be controlled to be operated by being linked with the heater 50.

Figure 4:
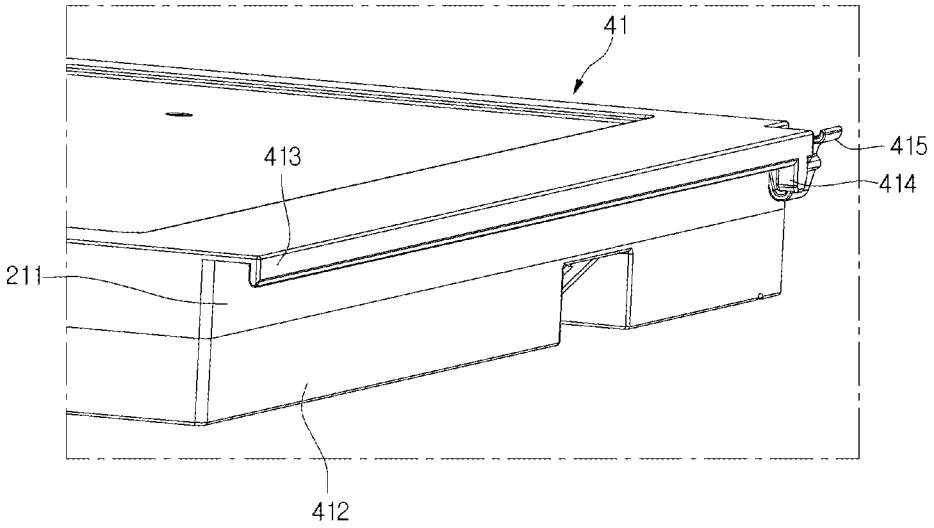
FIG. 4 is a partial perspective view showing a side of a separation member according to the embodiment of the present invention.
Figure 5:
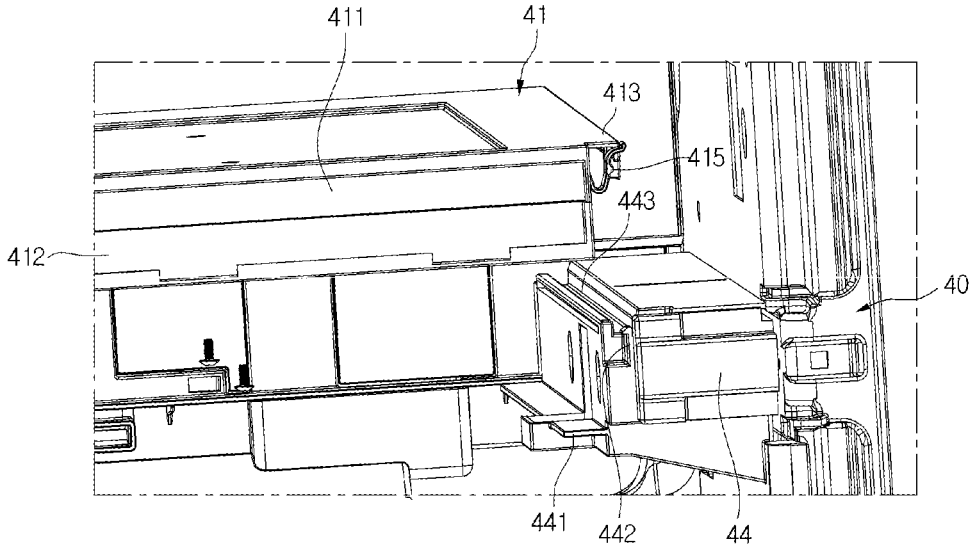
FIG. 5 is an exploded perspective view showing a shape before the separation member is mounted.
Figure 6:
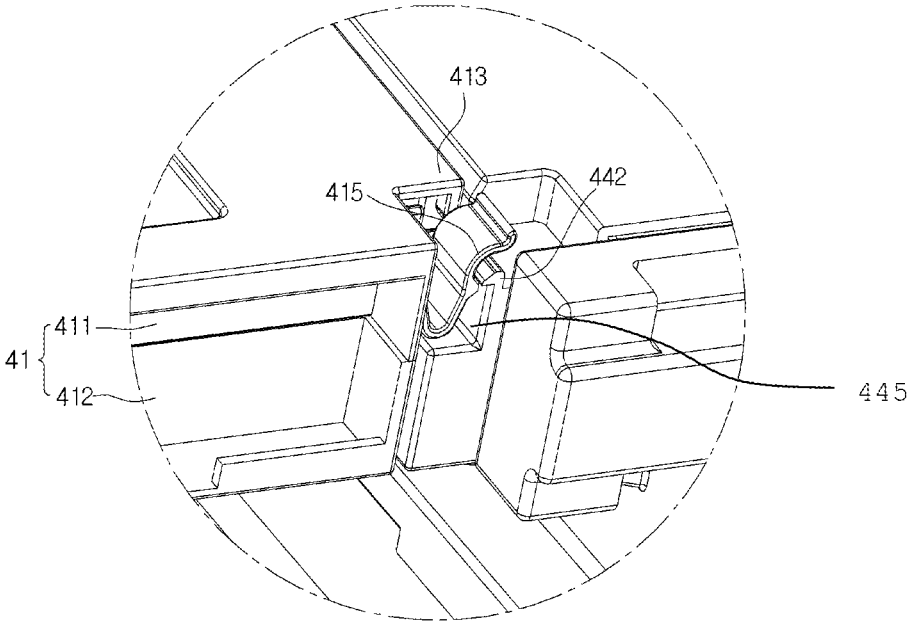
FIG. 6 is a partial perspective view showing a state where the separation member is mounted.

FIG. 4 is a partial perspective view showing a side of the separation member according to the embodiment of the present invention, FIG. 5 is an exploded perspective view showing a shape before the separation member is mounted, and FIG. 6 is a partial perspective view showing a state where the separation member is mounted.

Referring to FIGS. 4 to 6, the external appearance of the separation member 41 is formed by a combination of an upper plate 411 and a lower plate 412 and a heat insulating material is interposed between the upper plate 411 and the lower plate 412.

In detail, a locking hook 415 is formed at the front side of the upper plate 411 and a slide rib 413 is formed at both sides to be lengthily extended forward and backward. The slide rib 413 has a shape that extends by a predetermined width in a horizontal direction from the side of the upper plate 411 and then is cut downward. A stopper 414 is protruded downward at the front end portion of the slide rib 413.

Further, the supporter 44 that is mounted at the side wall of the housing 40 is formed with a locking hook 442 that is engaged with the locking hook 415. The supporter 44 defines a recess 445 that is located at a front portion of the supporter. Therefore, when the separation member 41 is seated at the supporter 44, the locking hook 415 of the separation member 41 is engaged with the locking hook 442 of the supporter 44 and a portion of the locking hook 415 extends into the recess 445.

In addition, a slide groove 443 in which the down bent portion of the slide rib 413 is seated is formed on the upper surface of the supporter 44. Although not shown, the slide groove 443 is formed with a groove into which the stopper 414 is inserted. Therefore, the stopper 414 is inserted into the groove, thereby preventing the separation member 41 from fluctuating forward and backward in the state where the separation member 41 is mounted. The side of the supporter 44 extends forward and backward in the state where the supporting rib 441 supporting the bottom edge of the separation member 41 has a predetermined width. Therefore, the bottom surface of both edges of the separation member 41 is seated in the supporting rib 441.

Hereinafter, the method for removing the separation member 41 having the above-mentioned configuration will be described.

First, the separation member 41 is seated in the supporting rib 441 in the state where the rear end portion of the separation member 41 is inclined downward. In this state, the separation member 41 is pushed backward, so that the rear end portion of the separation member 41 is closely attached to the rear wall of the housing 40. The slide rib 413 formed at both sides of the separation member moves along the slide groove 443 formed in the supporter 44. Then, the front end portion of the separation member 41 falls downward so that the front end portion of the separation member 41 is seated in the supporting rib 441. The separation member 41 is pressed so that the locking hook 415 of the separation member 41 is completely engaged with the locking hook 442 of the supporter 44. The locking hook 415 of the separation member 41 is engaged with the locking hook 442 of the supporter 44 and at the same time, the stopper 414 protruded at the front end portion of the slide rib 413 is inserted in the groove that is formed in the slide groove 443.

By the above-mentioned operation, the separation member 41 is fixedly mounted inside the housing and then, the horizontal bar 42 is assembled. The separation member 41 does not fluctuate in front, back, left, and right directions.

Meanwhile, in order to separate the separation member 41, the upward force is applied to the bottom surface of the separating member 41. At this time, it is preferable to pressurize a position close to the front end portion of the separation member 41, in detail, a point close to a position where the locking hook 415 and the stopper 414 are formed. The coupling between the locking hooks 215 and 242 is released and at the same time, the stopper 414 is separated from the groove.

In this state, the separation member 41 is lifted up while being maintained horizontally. When the separation member 41 is lifted up in the state where the separation member 41 is inclined in the down inclined direction as going to the rear, the front surface of the separation member 41 is interfered with the horizontal bar 42 such that it cannot be easily separated.

The user can easily couple and separate the separation member 41 through the coupling and separation processes of the above-mentioned separation member 41. When the user uses the inner space of the housing 40 into a single space and stores a large amount of freezing food, the user can separate the separation member 41 and remove the receiving box that is received in the convertible compartment 112*a*. In other words, the separate receiving box does not enter the convertible compartment 112*a* and only the door 13 moves forward and backward by the rail structure to selectively shield the front opening portion of the convertible compartment 112*a*.

Figure 7:
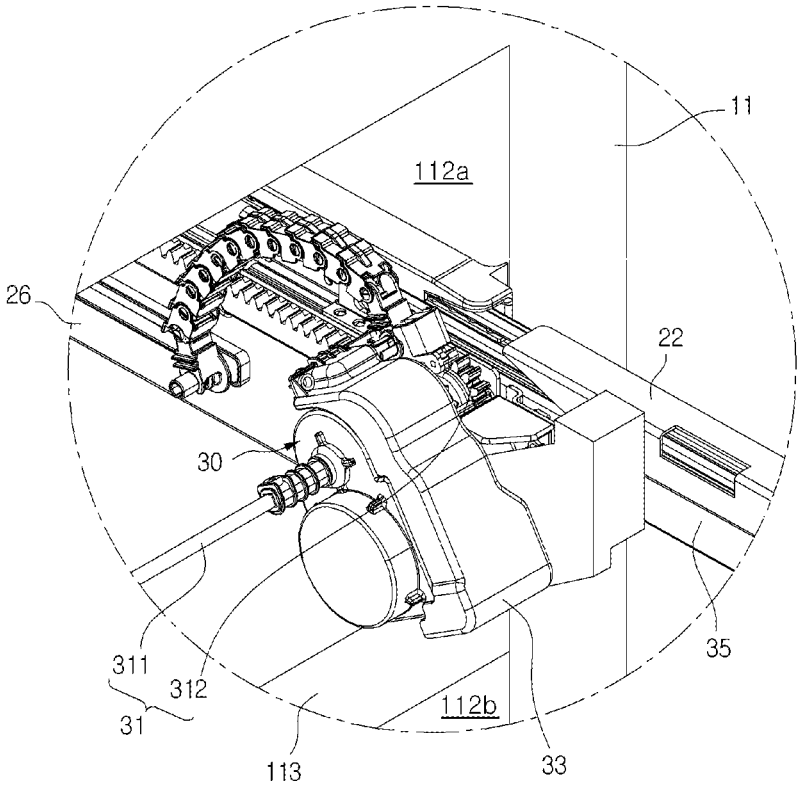
FIGS. 7 and 8 are diagrams showing a driving assembly that draws in and out a drawer provided in a convertible compartment of the refrigerator according to the embodiment of the present invention.
Figure 8:
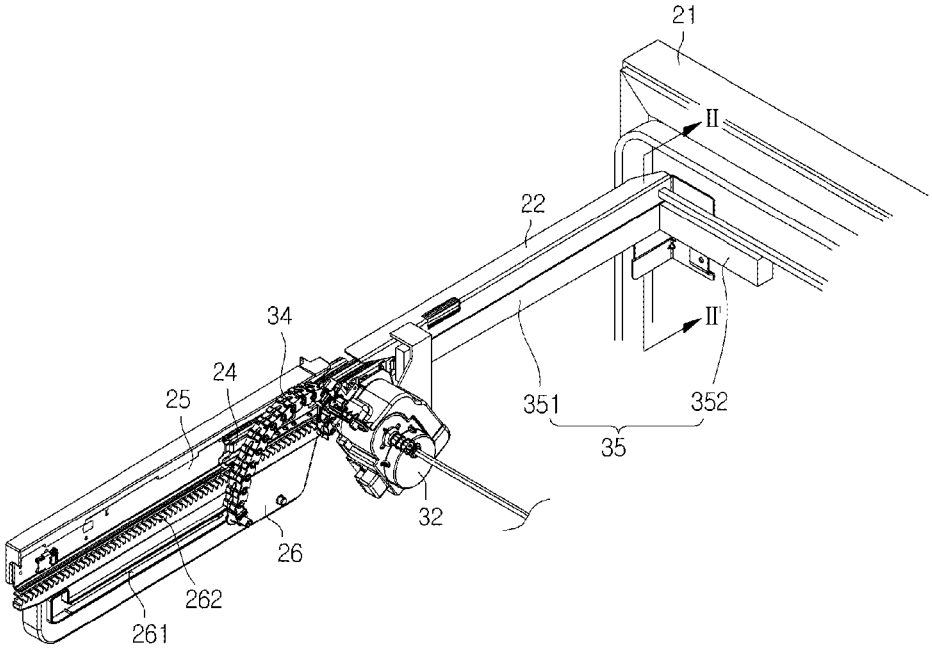
Figure 9:
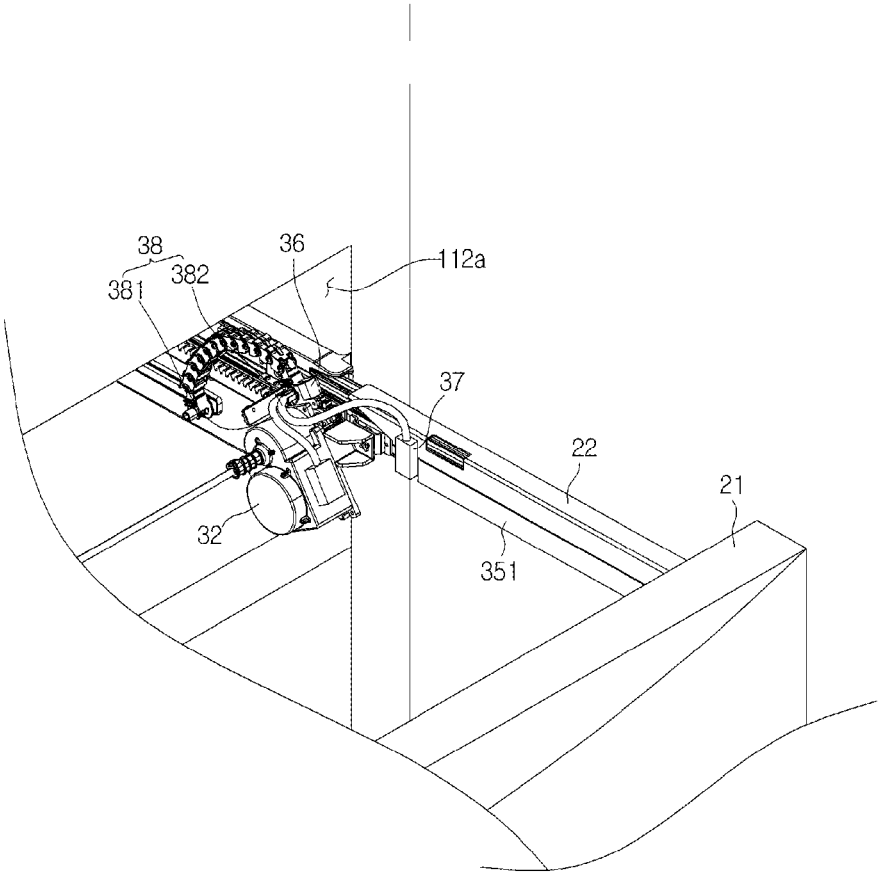
FIG. 9 is a diagram showing a state where a motor cover covering the driving assembly is removed.

FIGS. 7 and 8 are diagrams showing a driving assembly that draws in and out the drawer provided in the convertible compartment of the refrigerator according to the embodiment of the present invention and FIG. 9 is a diagram showing a state where a motor cover covering the driving assembly is removed.

It is noted that the following described contents can also be applied to the freezing compartment that is provided at the lower side of the convertible compartment.

Referring to FIGS. 7 to 9, the convertible compartment 112*a* according to the embodiment of the present invention is mounted with the drawer 20 as described above. The drawer 20 includes the door 21, the door frame 22, and the moving rail 24.

In detail, the inner side wall of the convertible compartment 112*a* is mounted with the rail guide 26. The rail guide 26 is a structure that guides the drawer 20 to be safely drawn in and out without shaking.

The rail guide 26 is mounted with the fixing rail 25 and the lower side of the portion where the fixing rail 25 is mounted is formed with a rack 262. The lower side of the rack 262 is lengthily formed with the cable guide hole 26 forward and backward.

In addition, the fixing rail 25 is slidably connected the moving rail 24 and the movement of the moving rail 24 is guided by the fixing rail 25. As described above, one or more intermediate rail is further connected between the fixing rail 25 and the moving rail 24 such that it can be drawn out in multi-stage.

Further, the cable 38 that extends from the main controller of the refrigerator main body and includes the power line and the signal line is exposed to the inside of the convertible compartment 112*a* by penetrating through the side wall of the convertible compartment 112*a*. When the drawer 20 moves, the cable 38 moves forward and backward along the cable guide hole 261.

Meanwhile, the rear end portion of the moving rail 24 is mounted with the drawer driving assembly 30. In detail, the drawer driving assembly 30 includes an anti-fluctuation member 31 and a driving motor 32 that drives the anti-fluctuation member 31.

In addition, a portion of the anti-fluctuation member 31 and the driving motor 32 is covered by the motor cover 33 to shield the external exposure. The cable 38 includes a motor cable 381 that is connected to the driving motor 32 and a operation unit cable 382 that is connected to the operation unit 213 of the door 31. The first fixing portion 36 is formed at a point where the motor cable 381 and the operation unit cable 382 are branched. The second fixing portion 37 is formed at the door frame 32 so that the operation unit cable 382 is fixed to the door frame 22. The cable 38 that penetrates through the convertible compartment 112*a* and extends to the first fixing portion 36 shields the external exposure by the first guide portion 34. The first fixing portion 36 and the second fixing portion 37 are covered by the motor cover 33 to shield the external exposure. The operation unit cable 382 that extends from the second fixing portion 37 to the rear surface of the door 21 is covered by the second guide portion 35 to shield the external exposure.

In more detail, both ends of the anti-fluctuation member 31 are connected to the rear end portion of the moving rail 24 that is mounted at both sides of the drawer 20. The anti-fluctuation member 31 includes a pair of pinions that moves along the rack 262 and the horizontal bar 311 that connects the pair of pinions 312. One end portion of the horizontal bar 311 may be directly connected to a motor shaft of the driving motor 32 and may be indirectly connected thereto by a connection gear. Each of The anti-fluctuation members 31 extends in a horizontal direction and is connected to the moving rail 24, thereby preventing the shaking when the drawer 20 moves forward and backward. The pinion 312 is supplied with the turning force of the driving motor 32 to perform the forward and backward rotation. Since the pinion 312 is engaged with the rack 262, the drawer 20 moves forward and backward by the rotation of the pinion 312.

Meanwhile, the first guide portion 34 is made in a chain form, such that a plurality of rotation joints are formed. Therefore, when the drawer 20 moves forward and backward, it is smoothly bent to prevent the cable 38 received therein from being damaged.

Moreover, the operation unit cable 382 extends to the rear surface of the door 21 along the moving rail 24. The second guide portion 35 is mounted at the moving rail 24 to cover the operation unit cable 382. The second guide portion 35 includes a frame side cover portion 351 that is coupled at the lower end portion of the door frame 22 and extends along the moving rail 24 and a door side cover portion 352 that is bent at the end portion of the frame side cover portion 351 and is fixed at the rear surface of the door 21.

Figure 10:
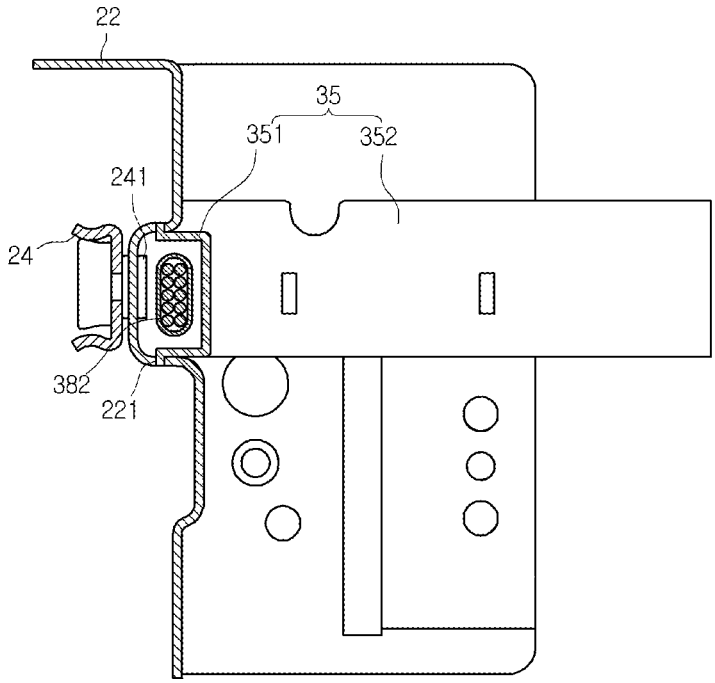
FIG. 10 is a cross-sectional view taken along line II-II' of FIG. 8.

FIG. 10 is a cross-sectional view taken along line II-II' of FIG. 8.

Referring to FIG. 10, the moving rail 24 is fixed to the door frame 22 by the locking hook 241. The frame side cover portion 351 of the second guide portion 35 is fixed to the door frame 22.

In detail, a portion of the frame side cover portion 351 is collapsed to an outer side as shown to form a space in which the operation unit cable 382 is received. The moving rail 24 may be fixed to a portion in which the door frame 22 is collapsed. The frame side cover portion 351 is fixed to a portion in which the door frame 22 is collapsed. The frame side cover portion 351 is bent in an opposite direction to a portion where the door frame is collapsed to form a space in which the operation unit cable 382 is received. A locking hole 221 is formed at a side wall of a portion where the door frame 22 is collapsed, such that the upper end and the lower end portion of the frame side cover portion 351 are inserted there into. As described above, the operation unit cable 382 extends along the door frame 22 and is shielded by the frame side cover portion 351 of the second guide portion 35, thereby making it possible to prevent it from being hung by food received in the drawer 20 or the damaged phenomenon during the movement of the drawer 20.

What is claimed is:

1. A refrigerator, comprising:

a main body including:

a refrigerating compartment that is located at an upper part of the main body;

a freezing compartment that is located below the refrigerating compartment; and an additional compartment that is located between the refrigerating compartment and the freezing compartment;

a refrigerating compartment door that is configured to open and close the refrigerating compartment;

a freezing compartment door that is configured to open and close the freezing compartment;

an additional compartment door that is configured to open and close the additional compartment, the additional compartment door including:

a front surface;

a rear surface that is located behind the front surface;

an upper surface that is configured to connect an upper end of the front surface and an upper end of the rear surface;

a bottom surface that is configured to connect a bottom end of the front surface and a bottom end of the rear surface;

a first side surface that is configured to connect a first end of the front surface and a first end of the rear surface;

a second side surface that is configured to connect a second end of the front surface and a second end of the rear surface; and an operation unit that is located on the upper surface and that is configured to select a temperature in the additional compartment;

a first door frame that is configured to horizontally extend rearward from a first side edge of the rear surface of the additional compartment door;

a second door frame that is configured to horizontally extend rearward from a second side edge of the rear surface of the additional compartment door;

a first rail guide that is located on a first side wall that defines the additional compartment;

a second rail guide that is located on a second side wall that defines the additional compartment;

a first rail assembly that is configured to connect the first door frame and the first rail guide, the first rail assembly including:

a first fixing rail that is configured to couple to the first rail guide; and a first moving rail that is configured to connect the first fixing rail and the first door frame and that is located on an outer side of the first door frame;

a second rail assembly that is configured to connect the second door frame and the second rail guide, the second rail assembly including:

a second fixing rail that is configured to couple to the second rail guide; and a second moving rail that is configured to connect the second fixing rail and the second door frame and that is located on an outer side of the second door frame;

a storage container that is detachably mounted to the first door frame and the second door frame;

an electrical cable that is configured to extend along an inner side of the first door frame or the second door frame and the rear surface of the additional compartment door;

a frame side cover portion that is located on a lower portion of the first door frame or the second door frame and that is configured to shield a portion of the electrical cable; and a door side cover portion that is bent at a front end of the frame side cover portion, that is configured to couple to the rear surface of the additional compartment door, and that is configured to shield a portion of the electrical cable.

2. The refrigerator of claim 1, further comprising a heating unit that is located on an outer surface of the additional compartment and that is configured to set the temperature of the additional compartment to be between a temperature of the freezing compartment and a temperature of the refrigerating compartment.

3. The refrigerator of claim 1, wherein a portion of the upper surface of the additional compartment door is inclined downward towards a front end of the additional compartment.

4. The refrigerator of claim 3, wherein the upper surface of the additional compartment door starts inclining from a position apart from a rear end of the additional compartment door.

5. The refrigerator of claim 1, wherein:

the first door frame or the second door frame includes a recess part that is configured to receive the electrical cable, and the frame side cover portion is configured to cover the electrical cable by coupling to the recess part.

6. The refrigerator of claim 5, wherein the recess part is located between the first moving rail or the second moving rail and the frame side cover portion by the first moving rail or the second moving rail being coupled to the recess part at the outer side of the first door frame or the second door frame.

* * * * *